United States Patent [19]

Leber

[11] 4,348,779

[45] Sep. 14, 1982

[54] INFLATABLE BOAT WITH ADDITIONAL INFLATABLE ELEMENTS COMPENSATING FOR LOSS IN BUOYANCY

[75] Inventor: Edmond Leber, Buhl, France

[73] Assignee: Sevylor, France

[21] Appl. No.: 65,105

[22] Filed: Aug. 9, 1979

Related U.S. Application Data

[63] Continuation of Ser. No. 851,189, Nov. 14, 1977, abandoned.

[30] Foreign Application Priority Data

Nov. 15, 1976 [FR] France ..... 76 34836

[51] Int. Cl.[3] ..... B63B 7/00; B63C 9/04

[52] U.S. Cl. ..... 114/345; 441/40

[58] Field of Search ..... 9/2 A, 11 A, 11 R; 115/17; 248/4, 5

[56] References Cited

U.S. PATENT DOCUMENTS 2,508,304 5/1950 Sturtevant ..... 9/2 A
2,962,732 12/1970 März ..... 9/2 A
4,021,873 5/1977 Francois ..... 9/2 A

FOREIGN PATENT DOCUMENTS 568444 4/1945 United Kingdom ..... 9/2 A

*Primary Examiner*—Douglas C. Butler
*Attorney, Agent, or Firm*—Robert E. Burns; Emmanuel J. Lobato; Bruce L. Adams

[57] ABSTRACT

This inflatable boat comprising at least one hull consisting of at least first and second elements disposed side by side, inflatable separately, and one or a plurality of additional elements inflatable separately and adapted to support one or a plurality of relatively heavy members to be secured to the hull, in case the first inflatable element becomes inoperative. Preferably, the additional element is included in the volume of the first element and in the upper portion thereof, in the vicinity of the wall of the second element, so that when the first element becomes inoperative the second element can support the additional inflatable element and the heavy member is kept in a fixed position. This heavy member may consist for example of an outboard motor or a sail mast supporting structure.

5 Claims, 13 Drawing Figures

20
56
58
61
63
26
28
23
21
22
57
26
62
61
55
28
23
22
21

INFLATABLE BOAT WITH ADDITIONAL INFLATABLE ELEMENTS COMPENSATING FOR LOSS IN BUOYANCY

This is a continuation, of application Ser. No. 851,189, filed Nov. 14, 1977 and now abandoned.

BACKGROUND OF THE INVENTION

The present invention relates to inflatable boats, of the type comprising at least one hull consisting at least partially of at least first and second elements disposed side by side and inflatable separately, and of one or a plurality of additional or complementary elements inflatable separately, capable of carrying one of a plurality of relatively heavy members adapted to be secured to the hull when the first inflatable element has become inoperative.

DESCRIPTION OF THE PRIOR ART

In known inflatable boats of this type, such as the single-hull boat illustrated in FIGS. 1 and 2 of the attached drawing, a heavy member consists of an outboard motor 4 disposed at the rear of the boat. If the first inflatable element 1 becomes inoperative for any reason the motor 4 is adapted to be carried by a single additional element 3 inflatable separately by means of a valve 15 located on one portion of the outer periphery or contour of the first hull element 1 and projecting therefrom beneath the mounting plate 5 for the outboard motor 4. Optionally, the mounting plate 5 for this motor is connected via a pair of oblique arms 6 to anchoring devices 7 bonded to the top surface of the upper hull portion 8. The aforesaid support means are rather objectionable for, though they ensure a relative buoyancy of motor 4 when the first inflatable element 1 becomes inoperative, in this occurrence they are not capable of holding the motor 4 in a fixed position. In fact, considering the usual dimensions of such boats, the additional inflatable element 3 cannot be made to dimensions sufficient for enabling its volume to compensate the weight of the outboard motor 4; on the other hand, notwithstanding the provision of a second inflatable element 2 and the optional pair of arms 6, the shaft of motor 4 assumes a position inclined in a vertical plane to the longitudinal axis of the boar, so that the normal propulsion is disturbed and the motor-driven propeller might under certain circumstances contact and damage the lower wall of the hull. Moreover, since the additional inflatable element 3 projects from the outer hull surface it is particularly exposed to tear and bursting.

In another known type of inflatable boat illustrated diagrammatically in FIGS. 3 to 5 of the drawings, the additional inflatable element 3 of FIG. 1 is replaced by a plurality of additional elements 9, 10, 11 and 12, 13, 14 inflatable separately from one another, and disposed above the hull, laterally, on either side of the outboard motor 4. Thus, when for any reason the first inflatable element 1 is put out of service these additional elements 9 to 14 constitute efficient floats for the motor 4, but unfortunately they suffer from the same inconveniences as those mentioned in the preceding paragraph with reference to FIG. 1.

SUMMARY OF THE INVENTION

The inflatable boat according to the present invention is free of the above-described inconveniences in that the additional inflatable element or elements may have dimensions considerably greater than those of prior art crafts while being less vulnerable to tear and bursting. The additional elements according to this invention have a considerably better buoyancy than the heavy member or members to be supported thereby when the first inflatable element becomes inoperative. The position of the heavy members is thus preserved more steadily and if one of them consists for example of an outboard motor the propulsion of the inflatable boat is not impaired and the lower portion of the hull is not liable to be damaged accidentally by the propeller.

The inflatable boat according to this invention comprises one or a plurality of additional inflatable elements incorporated in the general volume of the first inflatable element and disposed in the upper portion thereof, in the vicinity of the wall of the second inflatable element, so that when for any reason the first inflatable element becomes inoperative the second element will properly support the additional inflatable element or elements.

In a typical form of embodiment of the inflatable boat according to this invention, the additional inflatable element or elements comprise flexible walls separate from those of the first inflatable element and are disposed within the latter, fastening means being provided for keeping said additional element or elements in the upper portion of said first inflatable element. According to another form of embodiment, the additional inflatable element or elements consist on the one hand of the wall of the upper portion of the first inflatable element and on the other hand of one or a plurality of additional flexible walls disposed above and/or beneath the first inflatable element and assembled in a water-tight manner along their outer contour with said upper wall of the first inflatable element.

According to a modified embodiment of the above-described structures, certain inflatable elements comprise several sections disposed side by side and successively along the wall of the second inflatable element, and adapted to be inflated separately from one another. According to another modified embodiment, certain additional inflatable elements comprise several sections disposed side by side and successively along the wall of the second inflatable element and each connected through air communication means to the adjacent section, so that all these sections can be inflated simultaneously.

Without departing from the basic principle of the present invention, the first inflatable element may be oriented towards the inside of the boat, as in the case of boats pertaining to the prior art referred to hereinabove wherein the heavy member is an outboard supported by said external hull element. The first inflatable element could as well be disposed towards the interior of the boat and a heavy member would then be supported by said internal hull element. According to certain possible forms of embodiment of this modified version of the inflatable boat of this invention, the first and second inflatable elements comprise each one or a plurality of additional inflatable sections or elements. The present invention is applicable both to single-hull boats of the type to be referred to presently, and to multi-hull boats such as catamaran or the like.

BRIEF DESCTIPTION OF THE DRAWINGS

FIGS. 1–5 inclusive are fragmentary views of inflatable boats according to the prior art;

DESCRIPTION OF THE PREFERRED EMBODIMENTS

Figure 1:
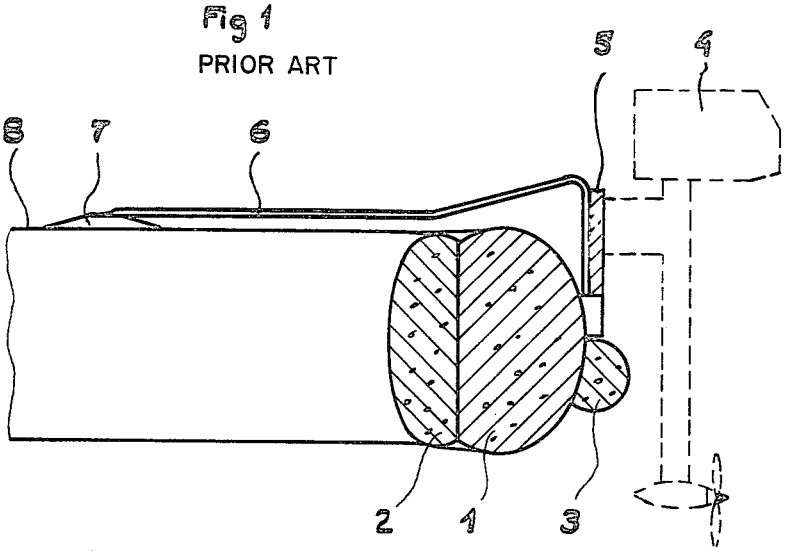
Fig 1 PRIOR ART
Figure 2:
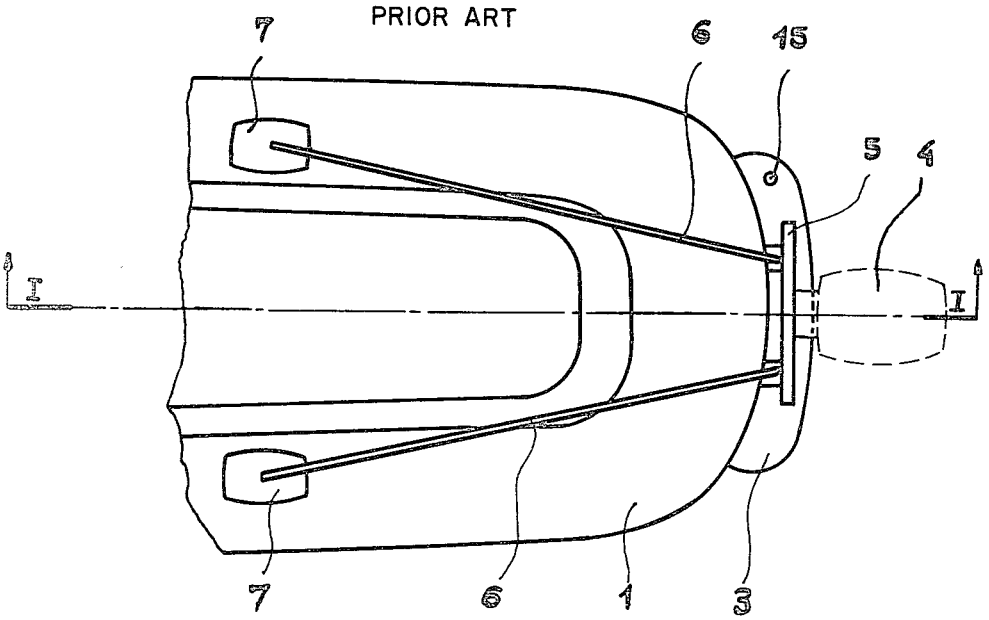
Fig 2 PRIOR ART
Figure 4:
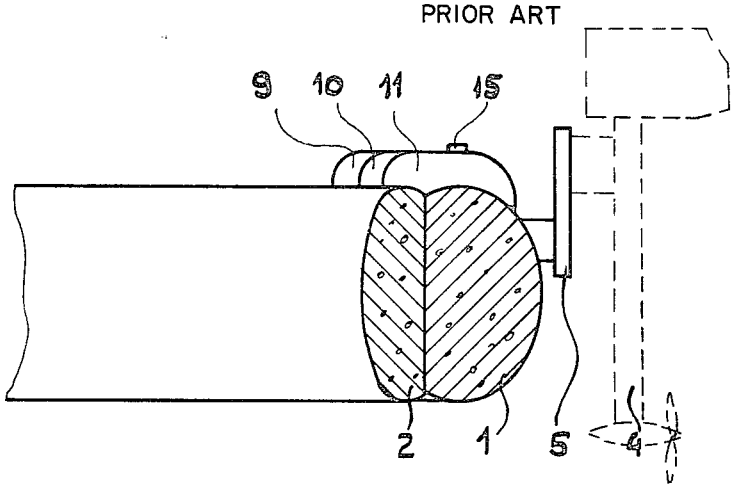
Fig 4 PRIOR ART
Figure 3:
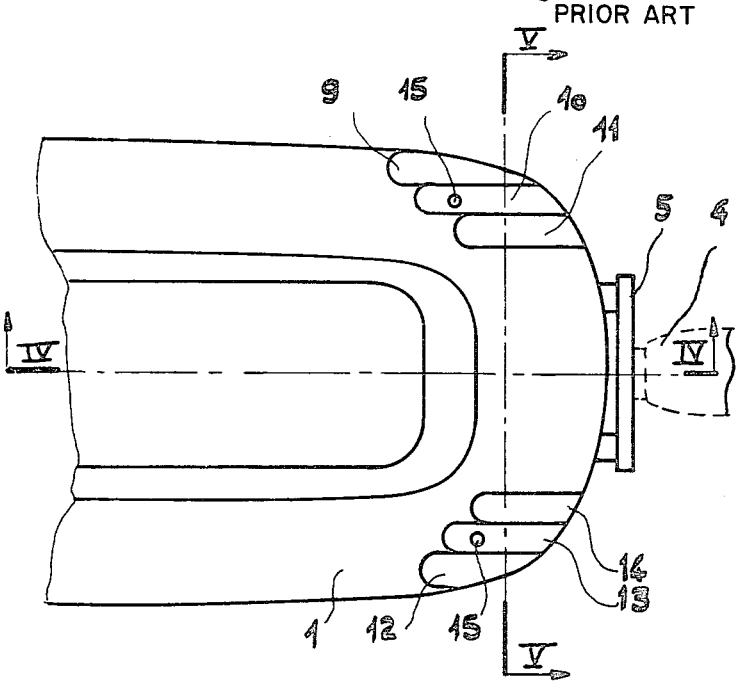
Fig 3 PRIOR ART
Figure 5:
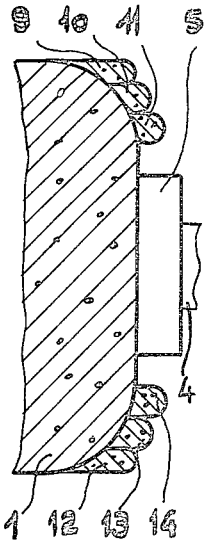
Fig 5 PRIOR ART
Figure 8:
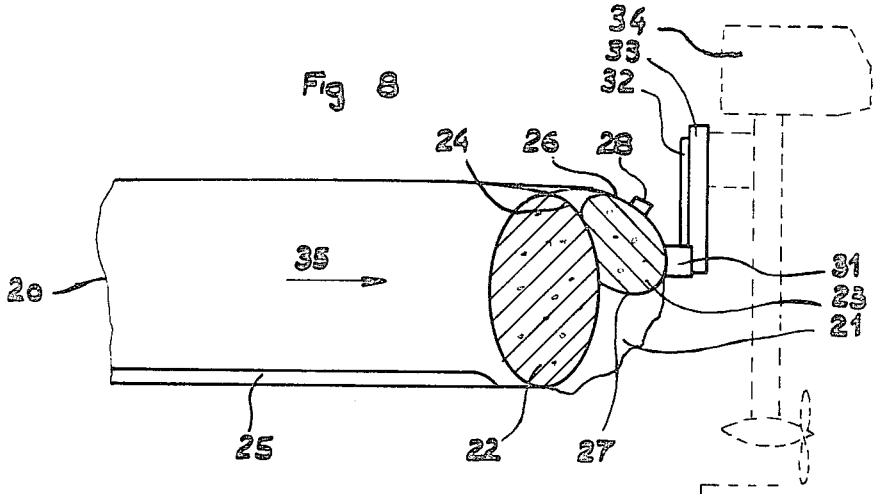
FIGS. 7 and 8 illustrate in fragmentary section taken along the lines VII—VII of FIG. 6 the same first form of embodiment with the first inflatable element inflated and deflated, respectively.
Figure 7:
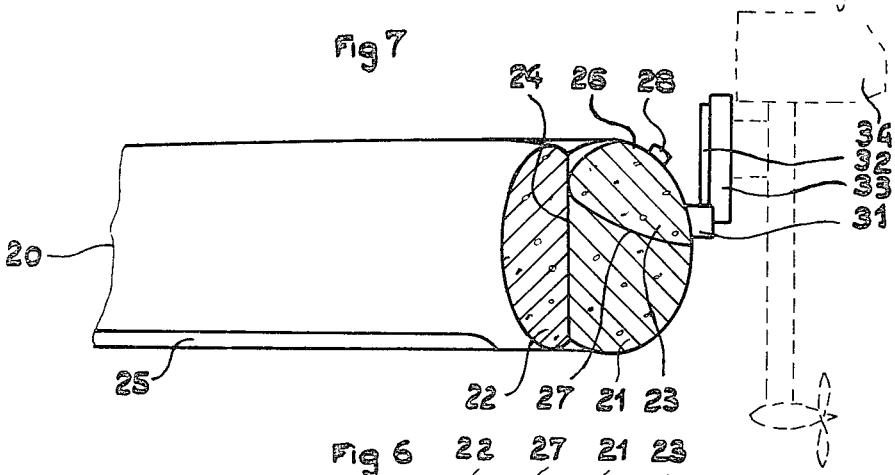
Figure 6:
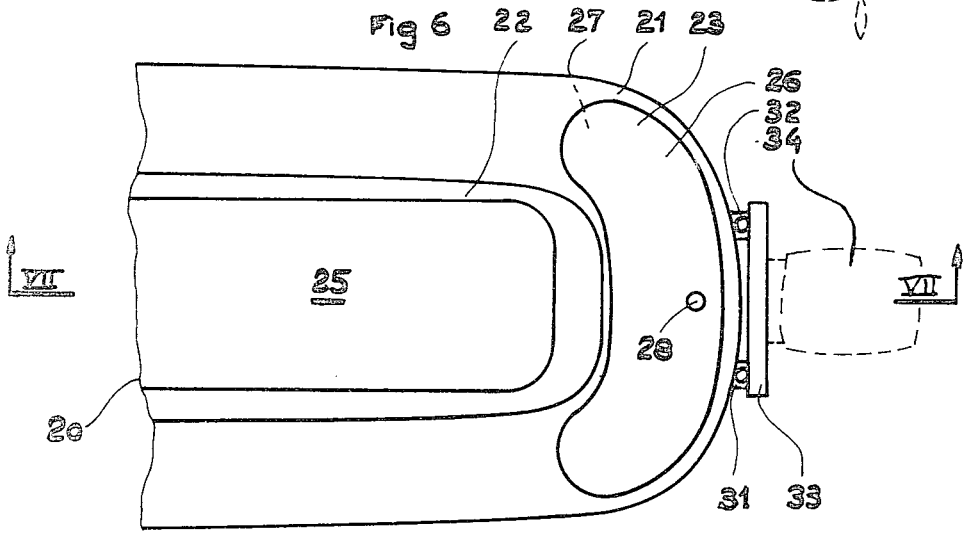
FIG. 6 is a fragmentary plane view from above showing a first form of embodiment of the invention.

As illustrated in FIGS. 6 to 8 of the drawings, the first form of embodiment of the inflatable boat according to the present invention comprises a hull 20 consisting of a first external inflatable element 21 and of a second internal inflatable element 22, a partition 24 being common to the two elements disposed side by side. This hull 20 further comprises a flat preferably inflatable bottom 25, and an additional element 23 consisting on the one hand of the wall 26 of the upper portion of the first inflatable element 21 and on the other hand of a flexible wall 27 underlying said wall 26 and assembled in a water-tight manner, for example by cementing or thermo-sealing or welding, along its periphery, to said wall 26. This additional inflatable element 23 is thus disposed at the upper portion of the first inflatable element 21 and the periphery of wall 27 thus added to the main wall of the first element 21 is so disposed that when the three inflatable elements are inflated the additional element 23 lies in close vicinity of, and along, the common partition 24 separating said elements 21 and 22; in the example illustrated the additional element 23 is constantly in contact with said partition 24, and lies within the volume of the first inflatable element 21. A valve 28 is provided for inflating the additional element 23 separately from the other inflatable elements. Support means 31 rigidly bonded to the wall 26 of the upper portion of first element 21 are therefore also rigidly assembled with the additional element 23. The support means 31 carry one end of upstanding tubular members 32 to which a board 33 is rigidly secured for receiving an outboard motor 34 intended for propelling the boat.

When all the elements 21, 22, 23 have been properly inflated, as illustrated in FIG. 7, the additional element 23 is almost invisible in the hull 20. Since elements 21 and 22 are inflated to substantially equal pressures, their common partition 24 is nearly flat and the additional element 23 bears against this partition 24.

If for any accidental reason the first inflatable element 21 were deflated, for example in case of tear occurring in its outer wall, as illustrated in FIG. 8, the common partition 24 then subjected only to the pressure existing in the second inflatable element 22 would tend to expand, as shown by the arrow 35 in the same Figure; thus as shown, this second inflatable element 22 assumes a more rounded shape and acts as a support to the additional inflatable element 23; therefore, the buoyancy produced by this additional element 23 is completed by a mechanical action tending to transfer to the second inflatable element 22 the stress received by the additional element 23, for example the motor weight. Thus, supports 31 and consequently the motor 34 remain in a fixed position.

Figure 10:
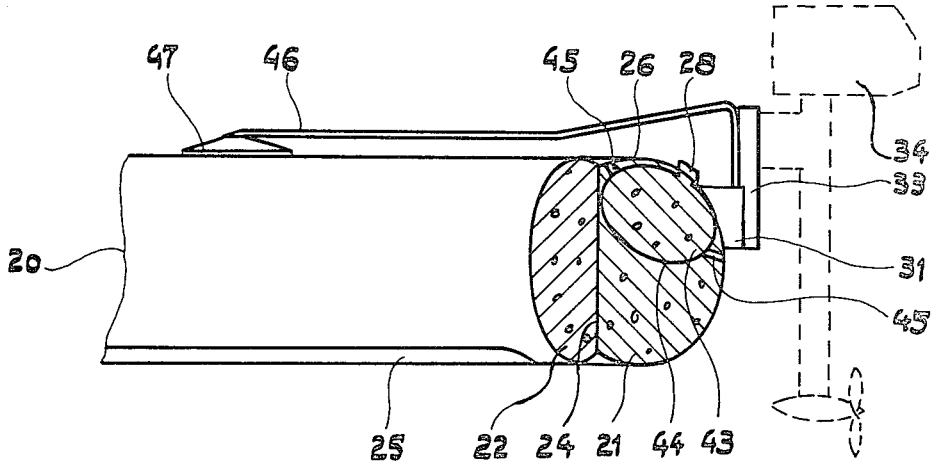
FIG. 10 illustrates in fragmentary section taken along the line X—X of FIG. 9 the second form of embodiment of the invention.
Figure 9:
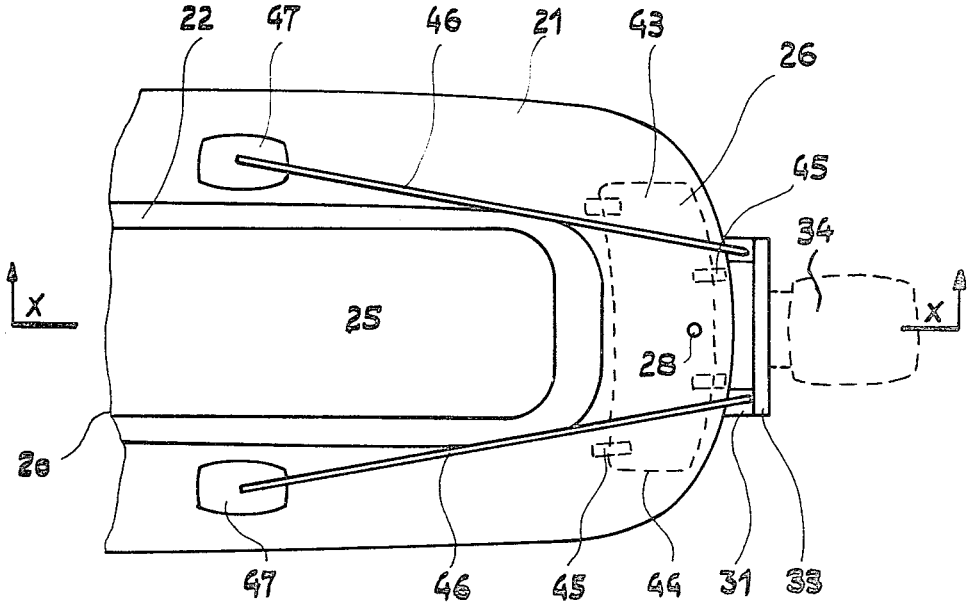
FIG. 9 is a fragmentary plane view from above showing another form of embodiment of the invention.

According to a modified form of embodiment illustrated in FIGS. 9 and 10 of the drawings, another additional element 43 is substituted for the additional element 23 of the first form of embodiment and comprises flexible walls 44 separate from the wall 26 of the first inflatable element 21. This additional element 43 has a substantially cylindrical configuration in its inflated condition and bears against the common wall 24 through the medium of fastening lugs 45. The tubular supports 32 of the first form of embodiment are replaced in this example by arms 46 secured at one end to supports 31 and at the opposite ends to the row-locks 47 rigid with each side of hull 20. Said supports 31 are rigid with the upper wall 26 of the first inflatable element 21 and disposed in close vicinity of the additional element 43. All the other component elements of the boat are similar to those in the first form of embodiment. This assembly operates also in the same manner as the first form of embodiment.

Figure 11:
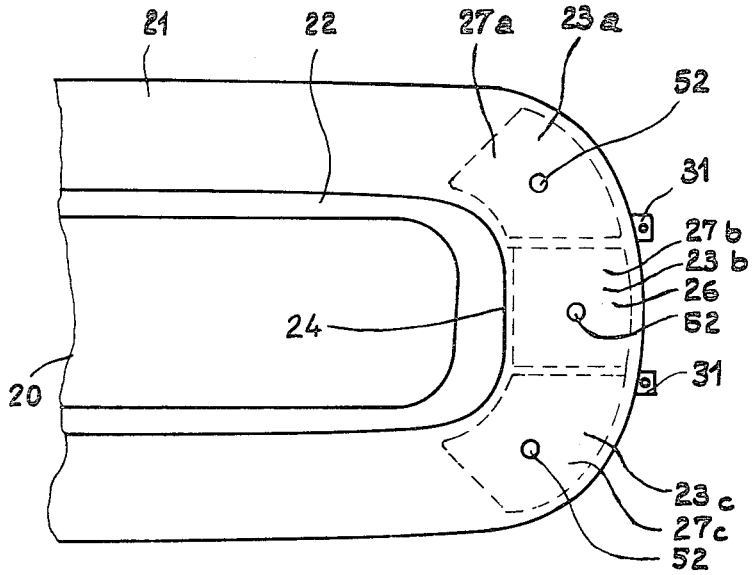
FIGS. 11 and 12 are fragmentary plane views from above of modified embodiments of the first and second forms of embodiment.

In another modified structure illustrated in FIG. 11 the additional element 23 which was single in the first form of embodiment shown in FIGS. 6 to 8 comprises a plurality of sections 23*a*, 23*b*, 23*c* disposed side by side and successively along the wall 24 common to both inflatable elements 21 and 22. A pair of valves 52 are provided for inflating separately the three sections of the additional element 23. These three sections are constructed in a manner somewhat similar to that of the single additional element 23 (FIG. 6). Three flexible walls 27*a*, 27*b* and 27*c* are heat-sealed along their peripheries under the wall 26 of the upper portion of the first inflatable element 21. The other elements, of which some are not shown in FIG. 11, are identical with those of the first form of embodiment of FIGS. 6 to 8. This assembly operates like the arrangement constituting the first form of embodiment of FIGS. 6 to 8.

Figure 12:
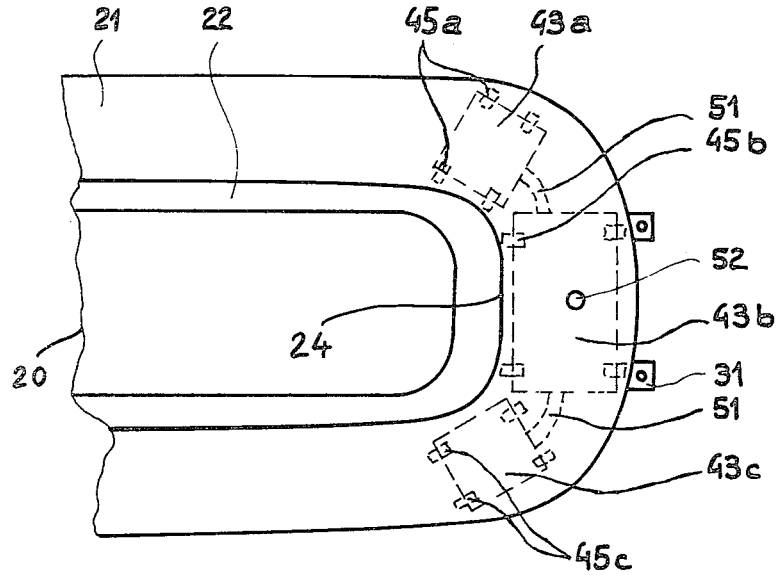

In a further modified form of embodiment illustrated in FIG. 12, the additional element 43 which was single in the second form of embodiment shown in FIGS. 9 and 10 comprises a plurality of sections 43*a*, 43*b*, 43*c* disposed side by side and successively along the common wall 24. Tubular members 51 interconnect the various sections 43*a*, 43*b* and 43*c*. A single valve 52 is provided for simultaneous inflating the three sections of this additional element 43. These sections 43*a*, 43*b* and 43*c* are constructed in a manner similar to that employed for constructing the single additional element 43 of FIGS. 9 and 10. The assembly operates substantially like the second form of embodiment and, with respect to this second form of embodiment, it can be located nearer to the common wall 24 since it consists of three sections 43*a*, 43*b* and 43*c* disposed along this common wall, thus improving the buoyancy of the assembly.

Figure 13:
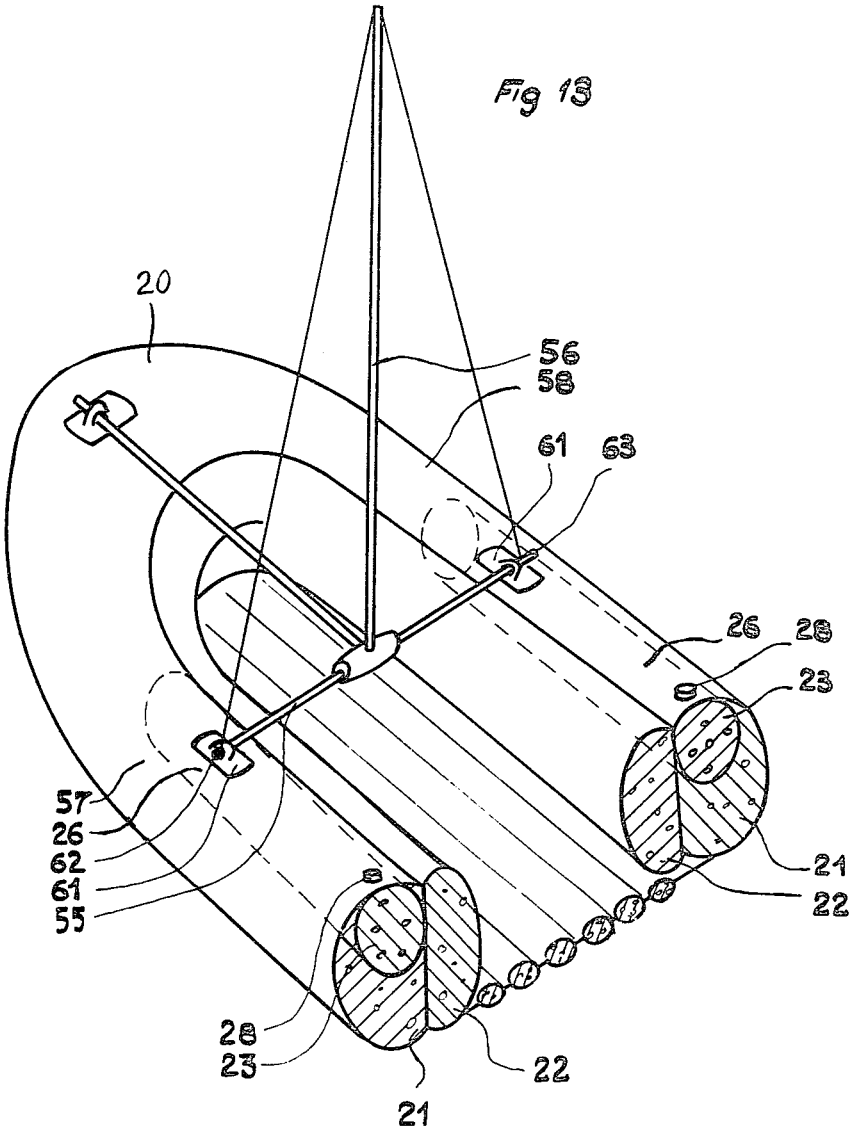
FIG. 13 illustrates a typical and practical application of the invention to an inflatable boat equipped with a structure for supporting a sail mast.

According to a specific application of the present invention, illustrated diagrammatically in FIG. 13 of the drawings, the heavy member consists of a structure 55 for supporting the mast 56 for sails (not shown). This structure 55 is supported notably by the two sides 57 and 58 of the inflatable boat. The first inflatable element 21 encloses a pair of additional elements 23 adapted to be inflated separately and which, in this example, have a cylindrical configuration. Each additional element 23 underlies the row-locks 61 rigid with the outer ends 62 and 63 of the supporting structure 55, said row-locks 61 being rigid for example with the upper surface of the wall 26 common to the first inflatable element 21 and to each additional inflatable element 23. In case the first inflatable element 21 becomes inoperative, for example in case of tear, the additional inflatable elements 22 and 23 have the same function as that described hereinabove with reference to the first form of embodiment. They are thus capable of maintaining the structure 55 and the mast 56 supported thereby in their initial position with respect to the hull 20, so that the sails can be used even in case the first inflatable element 21 becomes inoperative.

The inflatable boat according to this invention may be utilized in all cases wherein some of its portions are to support relatively heavy members such as an outboard propulsion motor, or a supporting structure for the sail mast.

What is claimed as new is:

1. An inflatable boat comprising, a hull comprising first and second inflatable elements disposed side-by-side and inflatable separately of sufficient buoyancy for supporting at least one of relatively heavy members secured to the hull, a plurality of additional separately inflatable elements in said hull disposed for buoyantly supporting at least one of said relatively heavy members and having a common wall and at least one of said additional inflatable elements being effectively expandable upon an adjacent one of the additional inflatable elements having said common wall rupturing, said at least one of said additional inflatable elements being disposed internally of one of said additional inflatable elements for effectively assisting in buoyantly supporting said at least one relatively heavy member upon expanding thereof, and said at least one additional inflatable element effectively expanding to maintain substantially the same buoyancy of said hull in the vicinity of said relatively heavy member prior to the rupturing of said adjacent one of the additional inflatable elements.

2. An inflatable boat according to claim 1, including fastening means to fasten said additional inflatable elements to one of said first and second inflatable elements.

3. An inflatable boat according to claim 1, in which said at least one of said additional inflatable elements is in communication with one of said first and second inflatable elements.

4. An inflatable boat comprising, a hull comprising first and second inflatable elements disposed side-by-side and inflatable separately, additional buoyancy elements at least one of which is in communication with one of said first and second elements and automatically expandable upon a next adjacent one of the additional buoyancy elements adjacent to said at least one of said additional buoyancy elements being ruptured, and said at least one additional buoyancy element automatically expandable to a volume to maintain the buoyancy of the additional buoyancy elements at a location in said hull substantially the same as prior to said rupturing.

5. An inflatable boat comprising a hull, first and second expandable inflatable elements disposed side-by-side and inflatable separately of sufficient buoyancy for supporting at least one heavy member secured to the hull, an additional expandable separately inflatable element disposed internally of said first inflatable element and located in the upper portion thereof, said additional expandable separately inflatable element automatically expanding upon rupture of said first inflatable elements and said second flatable element being disposed to expand upon rupture of said first element and having a wall effective to support said additional inflatable element upon expansion to maintain buoyancy sufficient to maintain said heavy member approximately in position.

* * * * *